United States Patent [19]

Freitag et al.

[11] 4,394,160

[45] Jul. 19, 1983

[54] MAKING MAGNETIC POWDERS

[75] Inventors: Walter O. Freitag, Dresher; Victor V. Suchodolski, Erdenheim, both of Pa.

[73] Assignee: Sperry Corporation, New York, N.Y.

[21] Appl. No.: 99,365

[22] Filed: Dec. 3, 1979

[51] Int. Cl.[3] ..... C22C 1/04; H01F 1/02

[52] U.S. Cl. ..... 75/0.5 AA; 148/105; 148/108; 428/900

[58] Field of Search ..... 428/900; 75/0.5 AA; 148/105, 108, 121, 122; 427/127, 128, 129

[56] References Cited

U.S. PATENT DOCUMENTS 3,966,510 6/1976 Aonuma et al. ..... 75/0.5 AA 3,986,901 10/1976 Plante et al. ..... 148/105

4,020,236 4/1977 Aonuma et al. ..... 75/0.5 AA 4,096,316 6/1978 Tamai et al. ..... 428/457

*Primary Examiner*—William R. Dixon, Jr.

*Attorney, Agent, or Firm*—James R. Bell; Marshall M. Truex

[57] ABSTRACT

Magnetic powders for use in the manufacture of magnetic recording media are produced by a borohydride process in which aqueous solutions of ferrous sulfate and sodium borohydride are mixed in a magnetic field. The coercive force of the magnetic powder produced as a result of this method is controlled by controlling the temperature of the reactant solutions prior to mixing thereof.

7 Claims, 1 Drawing Figure

MAKING MAGNETIC POWDERS

BACKGROUND OF THE INVENTION

1. Field of the Invention

The invention relates generally to a method of making magnetic powders for use in the manufacture of magnetic recording media. More particularly, the invention relates to an improvement in the borohydride process of making magnetic powders of the indicated type.

2. Description of the Prior Art

It is known to make magnetic powders of the indicated type by the borohydride reduction of salts of ferromagnetic elements. Examples of such methods are those described in U.S. Pat. Nos. 3,932,293; 4,009,111; and 4,096,316.

Although the aforecited patents disclose various processes for producing magnetic powders, no one of said patents teaches that the coercive force ($H_c$) of the resulting powder can be controlled by the utilization of critical temperature conditions. Accordingly, there has been a need for a workable method of making magnetic powders of the indicated type having a selected and predictably controlled coercive force. In the manufacture of magnetic recording media it is critical that the coercive force of the media be controlled to a predetermined magnitude. It is important that such media have a predetermined coercivity so that they can function in a predictable manner as tapes, discs or the like. Moreover, this desired coercivity varies with a particular application.

Other prior art methods known to applicant are those disclosed in U.S. Pat. Nos. 4,101,311; 4,076,861; 4,069,073; 4,063,000; 3,966,510; 3,756,866; 3,661,556; 3,567,525; 3,535,104 and 3,206,338.

As discussed above, none of these patents teaches that the coercive force of the magnetic powder produced by the borohydride process can be controlled to a predictable magnitude.

SUMMARY OF THE INVENTION

It is the general object of this invention to provide a method of making magnetic powders for use in the manufacture of magnetic recording media by the borohydride reduction of salts of ferromagnetic elements in such manner as to selectively control the coercive force of the resulting powder.

Briefly stated, the method of this invention permits the selection of a desired magnitude of the coercive force of the magnetic powder produced by selectively controlling the temperatures of the reactant solutions prior to their being combined and mixed. More specifically, the method in accordance with this invention comprises the steps of (a) preparing a solution of a metal salt capable of forming a ferromagnetic material; (b) maintaining the solution of step (a) at a selected temperature; (c) preparing a solution of an alkali metal borohydride reducing agent; (d) maintaining the solution of step (b) at a selected temperature; and (e) mixing the solutions of steps (a) and (b) together while applying a magnetic field of a selected magnitude to said mixture during the reducing reaction between said solutions; the temperatures of said reactant solutions of steps (a) and (b) prior to the mixing being selected so as to control the coercive force of the magnetic powder produced from the mixture of step (e).

In accordance with this invention magnetic powders can be produced with predictable coercive forces ranging from approximately 300–700 oersteds by varying the selected temperatures of the reactant solutions prior to mixing from about 5° C. to about 50° C.

DESCRIPTION OF THE PREFERRED EMBODIMENTS

Figure 1:
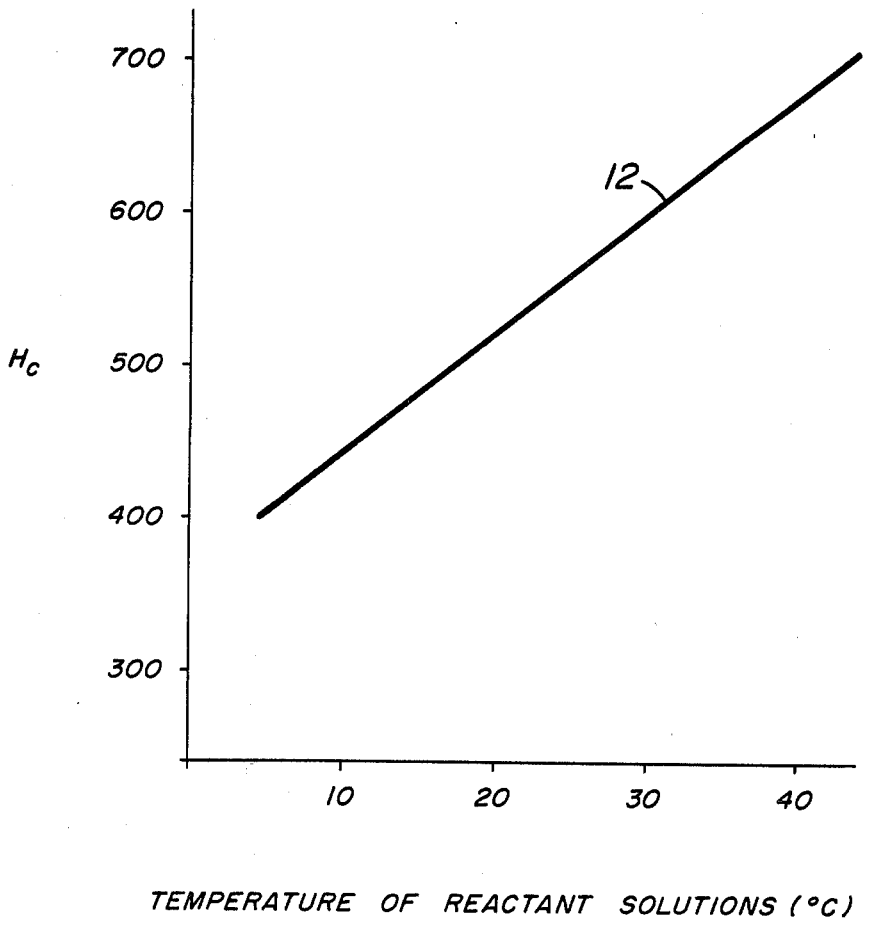
FIG. 1, is an illustration of the effect of the starting temperatures of the reactant solutions on the coercive force of the magnetic powder; it is a plot of the temperature of the reactant solutions (ordinate) versus the coercive force ($H_c$) in oersteds (abscissa).

As indicated above, the reduction of salts of ferromagnetic metals to magnetic powders by the use of borohydride ion is known and described in various patents. Accordingly, reference is made to U.S. Pat. Nos. 3,932,293 and 4,096,316 for details of the borohydride process.

In accordance with this invention, an aqueous solution of ferrous sulfate and an aqueous solution of sodium borohydride are maintained at a selected temperature in the range of from about +5° C. to +50° C. The solutions are then mixed while applying a magnetic force of a preselected magnitude as described in U.S. Pat. No. 3,932,293. The reaction takes place on a plastic disc rotating on a vertical axis within a tube. The two reactant solutions are delivered by a dual peristaltic pump to an array of jets. Each of the reactant streams is divided into four jets which are situated ninety degrees apart in a circular arrangement. The arrangement is such that there are eight streams impinging on the rotating disc so that very rapid mixing takes place. The spacing between the jets and the disc is about one centimeter and the entire reactant area is placed between the poles of a 0–2 KG electromagnet. The solutions react to give a black frothy suspension of powder which runs down the inner walls of the tube and is collected in water. The hydrogen is drained off to an exhaust hood.

The resulting powder slurry, which consists mostly of magnetic iron, is washed several times by decantation. The water is removed by a dewatering step which consists of washing the said slurry in a water miscible solvent, such as methyl alcohol. A small portion of the powder is dried and the magnetic properties are determined in a vibrating sample magnetometer in accordance with well known techniques. The powders produced are suitable, after dispersion in a binder as known in the art, for use as magnetic recording media.

In accordance with the improvement provided by this invention, the magnitude of the coercive force of the resulting powder can be determined by controlling the temperature of the reactant solutions within a precise range prior to mixing. Thus, for example, magnetic powders can be produced with a coercive force of from about 300 to about 700 oersteds by varying the premix temperatures from about 0° C. to about 50° C. Temperatures in the range of from about 5° C. to about 40° C. are especially preferred.

The following examples are given for illustration purposes only and variations thereof may be made by those skilled in the art without departing from the scope of the invention.

EXAMPLE 1

A 1.0 M solution of $FeSO_4.7H_2O$ (278 g/liter) was prepared, said solution having a pH of about 3.2 at 9° C. A 2.0 M solution of $NaBH_4$ (75.7 g/liter) was also prepared at a pH of 11.0 to 11.5 at 15° C. Both the ferrous sulfate solution and the sodium borohydride solution were comprised of distilled deaerated water and kept cold by means of an ice bath until they were pumped into a reactor. The temperature of the ferrous sulfate solution prior to mixing was 5° C. and the temperature of the sodium borohydride solution prior to mixing was 8° C., the average temperature of the two solutions being 6.5° C.

The two solutions were mixed in a reactor in a magnetic field of about 500 oersteds. The resultant slurry was washed in 12 liters of deaerated distilled water and rinsed in methanol. The slurry was filtered and the filtrate was dried to afford a powder which exhibits magnetic properties. The coercive force ($H_c$) of the powder was measured at 407 oersteds (Oe).

EXAMPLE 2

The procedure of Example 1 was repeated except that the temperature of both the ferrous sulfate solution and the borohydride solution were maintained at 7° C. The coercive force ($H_c$) of the resulting powder was determined to be about 424 oersteds.

EXAMPLES 3-6

The method described in Example 1 was repeated except that no ice bath was employed. Instead, the temperatures of the ferrous sulfate and sodium borohydride solutions were varied as indicated below:

In Example 3, the temperature of the ferrous sulfate solution prior to mixing was 15° C. and the temperature of the sodium borohydride solution was also 15° C., with the resulting coercive force ($H_c$) of the resulting powder being determined to be 484 oersteds.

In Example 4 the temperature of the ferrous sulfate and borohydride solutions prior to mixing were both 20° C. with the coercive force ($H_c$) of the resulting powder being 494 oersteds.

In Example 5 the temperatures of the ferrous sulfate and borohydride solutions prior to mixing were both 25° C. with the coercive force of the resulting powder being 550 oersteds.

In Example 6 the temperatures of the ferrous sulfate and sodium borohydride solutions prior to mixing were both adjusted to 40° C. and the resulting magnetic powder had a coercive force of 663 oersteds.

The coercive force ($H_c$) values of the Examples 1-6 were plotted against the starting temperature of the reactant solutions in FIG. 1 and are indicated by curve 12. It is apparent from this FIGURE that a careful selection of the temperature of the reactant solutions prior to mixing can result in the formation of magnetic powders which exhibit a consistent and desirable coercive force. Thus, curve 12 clearly indicates the relationship between the coercive force ($H_c$) and the temperature of the ferrous sulfate and borohydride solutions.

From the results in FIG. 1 it is clear that the temperature of the reactant solutions has a determinative effect on the coercive force of the resulting ferromagnetic powder. Specifically, curve 12 shows that the coercive force of the magnetic powder is directly and functionally dependent on the temperature of the reactant solutions prior to mixing. Accordingly, it is now possible to control the coercive force of a powder produced by the borohydride process to be a predetermined magnitude by controlling the temperature of the reactant solutions.

While the invention has been described in detail and with reference to specific embodiments thereof, it will be apparent to those skilled in the art that various changes and modifications can be made therein without departing from the spirit and scope thereof as defined by the following claims. For example various borohydride solutions may be used as is known in the art other than sodium borohydride and various metal salt solutions may be used other than ferrous sulfate.

What is claimed is:

1. A method of producing magnetic powders having a coercive force in the range of from about 300 Oe to 700 Oe for use in the manufacture of magnetic recording media which comprises:

(a) pre-determining the desired coercive force of said magnetic powders, (b) preparing a solution of metal salt capable of forming a ferromagnetic material, (c) maintaining the solution of Step (b) at a preselected temperature which is functionally determinate of the desired coercive force, said preselected temperature being within a range of from about 0° C. to 50° C., (d) preparing a solution of a borohydride reducing agent, (e) maintaining the solution of Step (d) at a preselected temperature which is functionally determinate of the desired coercive force, said preselected temperature being within a range of from about 0° C. to 50° C., (f) mixing the solutions of Steps (c) and (e) together while applying a magnetic field of a selected magnitude to said mixture during the reducing reaction between said solutions, the temperatures of said reactant solutions of Steps (c) and (e) prior to the mixing being pre-selected so as to control the coercive force of the magnetic powder produced from the mixture of Step (f).

2. The method of claim 1 wherein the temperature is maintained within a range of from about 5° C. to 40° C.

3. The method of claim 1 wherein solution of Step (b) is an aqueous solution of ferrous sulfate.

4. The method of claim 1 wherein said solution of Step (d) is an aqueous solution of sodium borohydride.

5. The method of claim 4 wherein said solution of Step (d) is an aqueous solution of sodium borohydride.

6. The method of claim 1 wherein said mixture of Step (f) is a powder slurry and includes the steps of dewatering said powder slurry with a water miscible organic solvent to remove the water therefrom to produce a magnetic powder suitable for use as a magnetic recording medium.

7. The method according to claim 6 wherein said coercive force of said powder is directly and functionally dependent on the preselected temperatures of Steps (c) and (e), as set forth in FIG. 1 at curve 12.

* * * * *